US007519475B2

(12) United States Patent
Newman

(10) Patent No.: US 7,519,475 B2
(45) Date of Patent: Apr. 14, 2009

(54) METHOD FOR DETERMINING BLOCK PROPERTIES OF A SERVICE RIG BY EVALUATING RIG DATA

(75) Inventor: Frederic M. Newman, Midland, TX (US)

(73) Assignee: Key Energy Services, Inc., Houston, TX (US)

( * ) Notice: Subject to any disclaimer, the term of this patent is extended or adjusted under 35 U.S.C. 154(b) by 152 days.

(21) Appl. No.: 11/517,919

(22) Filed: Sep. 8, 2006

(65) Prior Publication Data

US 2007/0089878 A1 Apr. 26, 2007

Related U.S. Application Data

(60) Provisional application No. 60/716,612, filed on Sep. 13, 2005.

(51) Int. Cl.
*G01V 1/40* (2006.01)

(52) U.S. Cl. ..... 702/9

(58) Field of Classification Search ..... 702/9
See application file for complete search history.

(56) References Cited

U.S. PATENT DOCUMENTS 4,114,435 A * 9/1978 Patton et al. ..... 73/152.45
4,156,467 A * 5/1979 Patton et al. ..... 173/21
4,356,557 A * 10/1982 Bell et al. ..... 702/163
4,434,971 A * 3/1984 Cordrey ..... 254/273
4,545,017 A * 10/1985 Richardson ..... 702/9
4,616,321 A * 10/1986 Chan ..... 702/9
5,107,705 A * 4/1992 Wraight et al. ..... 73/152.03
5,274,552 A * 12/1993 Milburn ..... 702/9
5,342,020 A * 8/1994 Stone ..... 254/269
6,079,490 A 6/2000 Newman
6,377,189 B1 4/2002 Newman
6,629,572 B2 * 10/2003 Womer et al. ..... 175/219
6,826,492 B2 11/2004 Newman
7,006,009 B2 2/2006 Newman
7,006,920 B2 * 2/2006 Newman et al. ..... 702/6
7,064,677 B2 6/2006 Newman
7,114,577 B2 10/2006 Newman
7,128,167 B2 * 10/2006 Dunlop et al. ..... 175/24
7,226,037 B2 * 6/2007 Newman ..... 254/274
2002/0060093 A1 * 5/2002 Womer et al. ..... 175/24
2004/0124009 A1 * 7/2004 Hoteit et al. ..... 175/25
2004/0124012 A1 * 7/2004 Dunlop et al. ..... 175/57
2004/0162658 A1 8/2004 Newman
2005/0114001 A1 5/2005 Newman

* cited by examiner

*Primary Examiner*—Michael P. Nghiem
*Assistant Examiner*—Cindy H Khuu
(74) *Attorney, Agent, or Firm*—King & Spalding LLP

(57) ABSTRACT

An operator of a well service rig can retrieve and monitor a display of data on the position of a block during rod and tubing insertion and removal. The operator inputs into the system a minimum and maximum height range that he wants the block to operate within. Data is provided to the operator, in real-time, on a charted display relative to the maximum and minimum position input by the operator to assist the operator in evaluating the position of the block prior to a crown-out or floor-out. In addition methods are provided for evaluating the activities conducted by a rig based on evaluation of the block position data in order to supervise a rig operation from an off-site site location. Furthermore, the technology allows the operator or supervisor to determine the speed of the block during operations by evaluating encoder velocity data provided by an encoder velocity chart.

19 Claims, 15 Drawing Sheets

METHOD FOR DETERMINING BLOCK PROPERTIES OF A SERVICE RIG BY EVALUATING RIG DATA

STATEMENT OF RELATED PATENT APPLICATION

This non-provisional patent application claims priority under 35 U.S.C. § 119 to U.S. Provisional Patent Application No. 60/716,612, titled Interpretive Techniques Using Sensor Data, filed Sep. 13, 2005. This provisional application is hereby fully incorporated herein by reference.

FIELD OF THE INVENTION

The technical field of the present invention relates generally to evaluation of data concerning servicing hydrocarbon wells and more specifically to an evaluation of data obtained from a computerized workover rig adapted to record and transmit data concerning block position and speed during rig operations at a well site.

BACKGROUND OF THE INVENTION

After an oil drilling rig drills a well and installs the well casing, the rig is dismantled and removed from the site. From that point on, a mobile repair unit, or service rig, is typically used to service the well. Servicing includes, for example, installing and removing inner tubing strings, sucker rods, and pumps. This is generally done with a cable hoist system that includes a traveling block that raises and lowers the aforementioned tubing strings, sucker rods, and pumps.

Conventional systems describe methods for monitoring the movement of a traveling block on a drilling rig. In these conventional systems, the traveling block can be raised or lowered beyond a safe limit. This is called "crown out" if the traveling block goes above its upper-most safe position, and "floor out" if it goes below its lower-most safe is position. Crown out/floor out can result in equipment damage and/or present a hazard to personnel working on the equipment. Because it is often not possible for the operator of the cable hoist system to see the position of the traveling block, or because the operator can be otherwise distracted from the position of the traveling block, the operator can inadvertently exceed safe positions of the traveling block.

Although many conventional methods set out to solve the problem of unsafe hoist operation in an oil drilling rig, many drawbacks still remain when applying the these technologies to a service rig. For instance, in many cases the operator cannot see the block and needs the ability to make decisions based on the where the block is located without actually seeing the block. In addition evaluators, such as supervisors, service rig owners or well owners need a way to evaluate the effectiveness of a rig operator's actions and safety regarding the position of the block during rig operations.

The present invention is directed to evaluating block position from a display of block position data and determining whether to continue raising or lowering the block based on the displayed data. In addition, the present invention is directed to methods for evaluating block position data and encoder velocity data to determine the activities that occurred on the service rig and the speed at which the block was operating on the service rig.

SUMMARY OF THE INVENTION

The present invention is directed to an evaluation of block position and encoder velocity data from a well service rig at a well site. The invention contemplates that the data can be evaluated to determine the actions to be taken with regards to raising and lowering the block, to determine the speed of the block, and to determine the activities occurring at the well service rig, either in real-time or based on a post-operation evaluation of the data. The data can be transmitted to the rig and to an off-site location in near real-time or periodically via wired, wireless, satellite or physical transfer such as by memory module to a data center preferably controlled by the service rig owner, but alternately controlled by the well owner or another third party.

For one aspect of the present invention, a method for determining an activity completed by a service rig can include evaluating a display of block position data on a block position data chart. A service rig operator, supervisor or third party can identify multiple data points of block position data on the block position data chart as a first activity. Once a first activity has been identified in the data on the block position data chart, the first activity can be determined by evaluating the multiple data points of block position data. In one exemplary embodiment, the plurality of block position data can include multiple peaks and troughs along a curve that can represent the position of the block.

For another aspect of the present invention, a method for operating a block on a service rig by analyzing a block position data chart can include evaluating a first data point on the block position data chart. The method can also include a determination of whether a block has removed a tubular from a well. If the block has not fully removed the tubular from the well, a determination can be made as to whether the first data point is substantially near an upper limit on the block position data chart. The removal of the tubular can be stopped if the first data point is substantially near the upper limit on the block position data chart. In addition, the block can be allowed to continue raising the tubular from the well if the first data point is not substantially near the upper limit on the block position data chart.

For yet another aspect of the present invention, a method for operating a block on a service rig by analyzing a block position data chart can include evaluating a first data point on the block position data chart. The method can also include a determination of whether a block has raised the tubular high enough so that it may be inserted into the well. If the block has not raised the tubular high enough so that it may be inserted into the well, a determination can be made as to whether the first data point is substantially near an upper limit on the block position data chart. The removal of the tubular can be stopped if the first data point is substantially near the upper limit on the block position data chart. In addition, the block can be allowed to continue raising the tubular into a position high enough so that it may be inserted into the well if the first data point is not substantially near the upper limit on the block position data chart.

For a further aspect of the present invention, a method for operating a block on a service rig by analyzing a block position data chart can include evaluating a first data point on the block position data chart. The method can also include a determination of whether a block has inserted a tubular into a well. If the block has not inserted the tubular into the well to a point sufficient to allow it to be released by the block so that another tubular may be retrieved, a determination can be made as to whether the first data point is substantially near a lower limit on the block position data chart. The insertion of the tubular into the well can be stopped if the first data point is substantially near the lower limit on the block position data chart. In addition, the block can be allowed to continue inserting the tubular into the well if the first data point is not substantially near the lower limit on the block position data chart.

For still another aspect of the present invention, a method for operating a block on a service rig by analyzing a block position data chart can include evaluating a first data point on the block position data chart. The method can also include a determination of whether a block has been lowered to a position low enough to remove the next tubular from a well. If the block has been lowered to a position low enough to remove the next tubular from a well, a determination can be made as to whether the first data point is substantially near a lower limit on the block position data chart. The lowering of the block to retrieve the next tubular and remove it from the well can be stopped if the first data point is substantially near the lower limit on the block position data chart. In addition, the block can be allowed to descend to retrieve the next tubular to be removed from the well if the first data point is not substantially near the lower limit on the block position data chart.

For another aspect of the present invention, a method of determining the velocity of a block on a service rig by analyzing an encoder velocity chart can include selecting an encoder velocity data point on the encoder velocity chart. The encoder count for the encoder velocity data point and the number of encoder pulses for a single revolution of a hoist drum that raises and lowers the block can be determined. The rotational speed, in revolutions per a period of time, can be determined by taking the quotient of the encoder count divided by the number of encoder pulses for a single revolution of the hoist drum. The circumference of the core of the drum hoist can be determined and multiplied by the quotient to obtain the speed of the block at the selected encoder velocity data point.

BRIEF DESCRIPTION OF DRAWINGS

For a more complete understanding of the exemplary embodiments of the present invention and the advantages thereof, reference is now made to the following description in conjunction with the accompanying drawings in which.

DETAILED DESCRIPTION OF THE EXEMPLARY EMBODIMENTS

Figure 1:
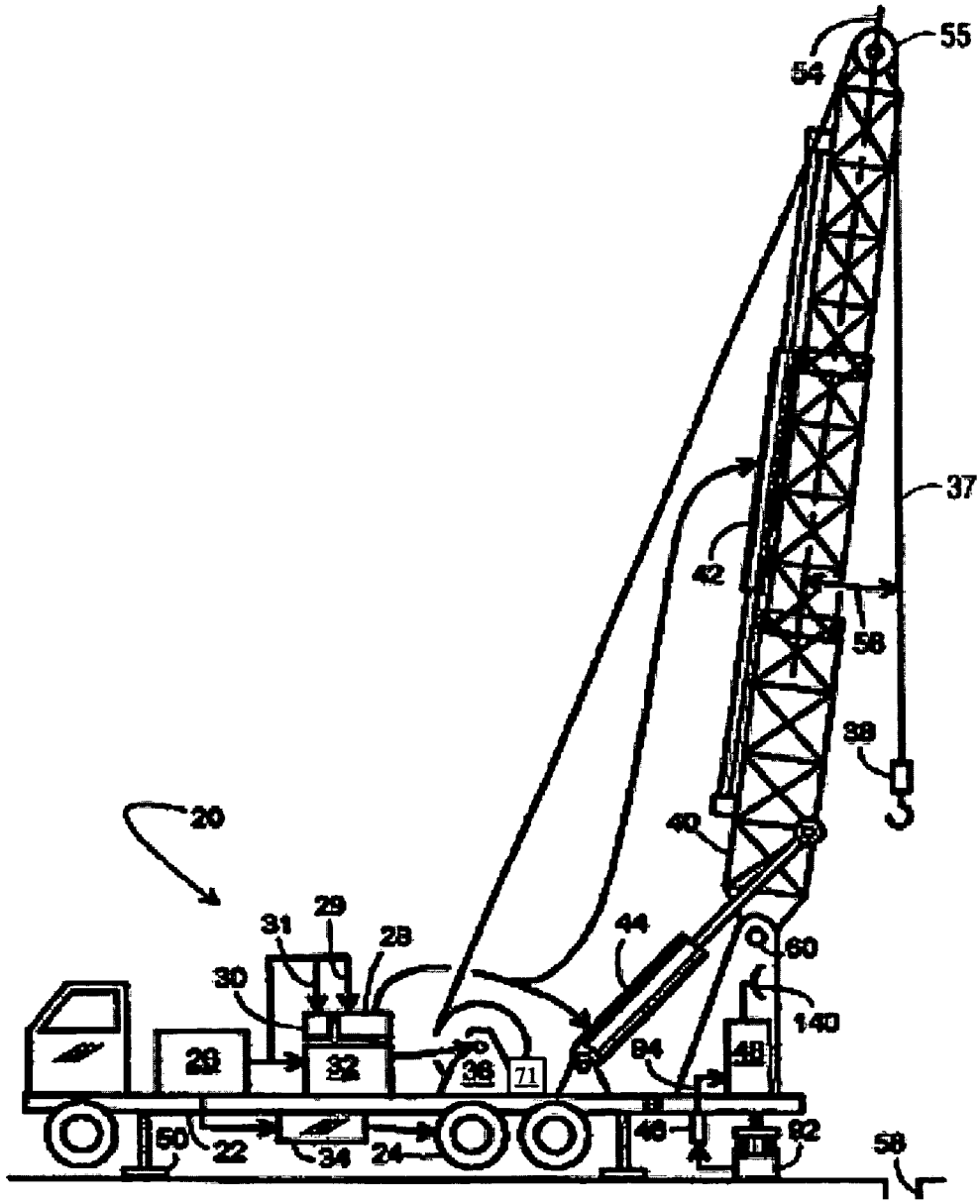
FIG. 1 is a side view of a service rig with its derrick extended according to one exemplary embodiment of the present invention.

Because the mobile service rig is typically the center of workover or service operations at the well site, the present invention is directed to incrementing the service rig in such a manner that activity-based and/or time-based data for the well site is recorded. The invention contemplates that the acquired data can be monitored by a rig operator or transmitted in near real-time or periodically via wired, wireless, satellite or physical transfer, such as by memory module to a data center preferably controlled by the service rig owner, but alternately controlled by the well owner or another. The data can thereafter be used to evaluate the data and supervise from off-site the activities of the well service rig. This latter implementation of the invention permits a service rig owner, supervisor, or well-owner customer to monitor the work being completed by the well service rig and other third parties based on data that is provided and can be reviewed after the fact or substantially in real-time. As described below in more detail, by accessing the data through a regularly updated web portal, the customer may be able to determine in near real time the activities being accomplished by the service rig. With such information, the owner or supervisor can provide customers with more accurate billing and train or discipline service rig crews based on their activities and their completion times. Further, the customer will have access to detailed data on the actual service performed and can then verify its invoices. In addition, the owner or supervisor can evaluate the data to determine the efficiency and correctness of the written reports generated by the service rig operator.

The present invention fosters a synergistic relationship among the customer and the service companies that promotes a safe environment by monitoring crew work activities and equipment speeds, improving productivity, reducing operation expenses through improved job processes, better data management, and reduced operational failures.

Implementation of the invention on a conventional service rig can be conceptualized in two main aspects: 1) acquisition, recordation and transmission of transducer data such as encoder velocity, block position, hook load, hydraulic pressure, etc. and 2) acquisition, recordation, and transmission of service-based activity, such as "Learn High," "Learn Low," "Rig Up," and "Nipple Up Blow Out Preventer," among others. Acquisition of physical transducer or sensor data can be achieved through automated means, such as a transducer that converts pressure to an electrical signal being fed to an analog-to-digital converter and then to a recoding means, such as a hard drive in a computer or memory in a microprocessor. Acquisition of service-based activity may be achieved by service rig operator input into a microprocessor-based system. It is contemplated that the transducer data and activity data may be acquired by and stored by the same or different systems, depending the design and requirements of the service rig.

In a certain implementation of the invention, it may be desirable to make the acquisition and storage of the data at the well site secure to the extent that the service rig operator or other service company representatives are not able to manipulate or adulterate the data. One implementation of this inventive concept is to not allow error correction in the field. In other words, if the rig operator inadvertently inputs that a tubing pull service has begun when in fact the operation is nippling up the BOP, the operator can immediately input that the tubing pull has ended and input that the nipple up process has started. Additionally or alternatively, the operator may annotate an activity entry, or annotation may be restricted to personnel at the data center. It is also contemplated that the operator (or other inputer) can have complete editorial control over the data (both transducer data and activity data) received into the storage system.

The following is a description of one exemplary embodiment of the present invention. It will be understood that this exemplary embodiment is but one way of implementing the present invention and does not necessarily implement all aspects of the invention. Therefore, the exemplary embodiment described below should not be construed to limit or define the outer boundaries of the present invention.

Capturing the physical activities that take place at the well site can be determined by an evaluation of the sensor data from the transducers or by having the operator of the service rig input what happens at the well site. Operator input is used to capture and classify what activities are taking place at the well site, the time the activities are taking place, any exception events that prevent, restrict, or extend the completion of an activity, and the primary cause and responsible party associated with the exception events. Operator input is obtained by having the operator enter the activity data into a computer or microprocessor as the different service operations are taking place so that the customer and the service provider can have an accurate depiction of what goes on at the well site.

In one exemplary embodiment, the operator can simply type the activity information into a computer located at the well site. In another embodiment, a computer is provided to the operator with a number of pre-identified activities already programmed therein. When the operator starts or stops an activity, he can simply push a button or an area on a touch-screen display associated with the computer to log the stopping or starting of that pre-identified service activity. In a further embodiment, the operator is provided with a hierarchy of service tasks from which to choose from. Preferably, this service hierarchy is designed to be intuitive to the operator, in that the hierarchy is laid out in a manner that is similar to the progression of various service activities at a well site.

Service activities at a well site can generally be divided into three activity identifiers: global day-in/day-out ("DIDO") well servicing activities, internal routine activities and external routine activities. DIDO activities are activities that occur almost every day that a service rig is at a well site. In the case of a mobile service rig, examples of DIDO activities include rigging up the service rig, pulling and laying down rods, pulling and laying down tubing, picking up and running tubing, picking up and running rods, and rigging down the service rig. Internal routine activities are those that frequently occur during well servicing activities, but aren't necessarily DIDO activities. Examples of internal routine activities include rigging up or rigging down an auxiliary service unit, longstroke, cut paraffin, nipple up/down a BOP, fishing, jarring, swabbing, flowback, drilling, clean out, well control activities such as killing the well or circulating fluid, unseating pumps, set/release tubing anchor, set/release packer, and pick up/laydown drill collars and/or other tools.

Figure 2:
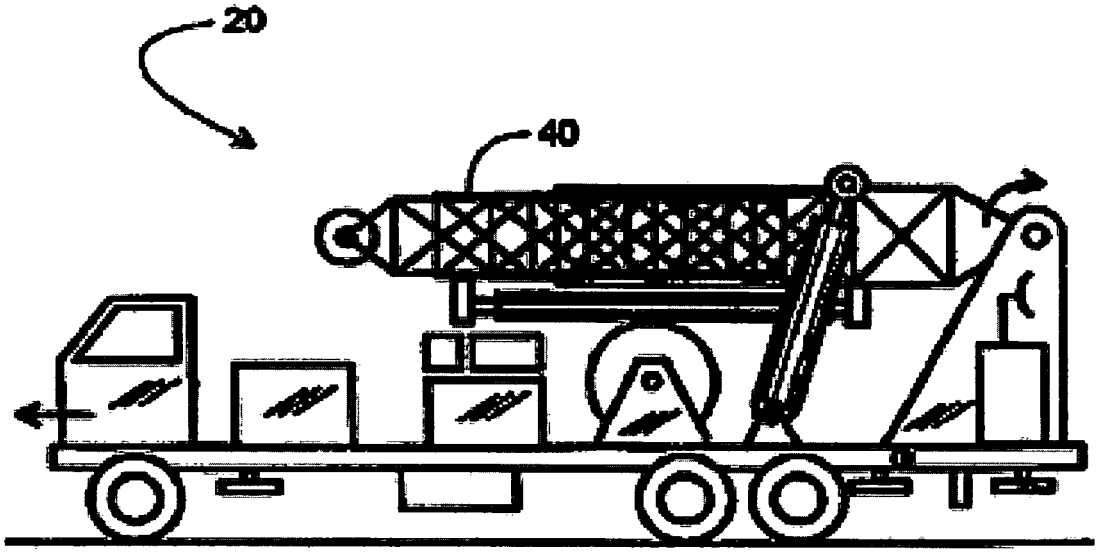
FIG. 2 is a side view of a service rig with its derrick retracted according to one exemplary embodiment of the present invention.
Figure 3:
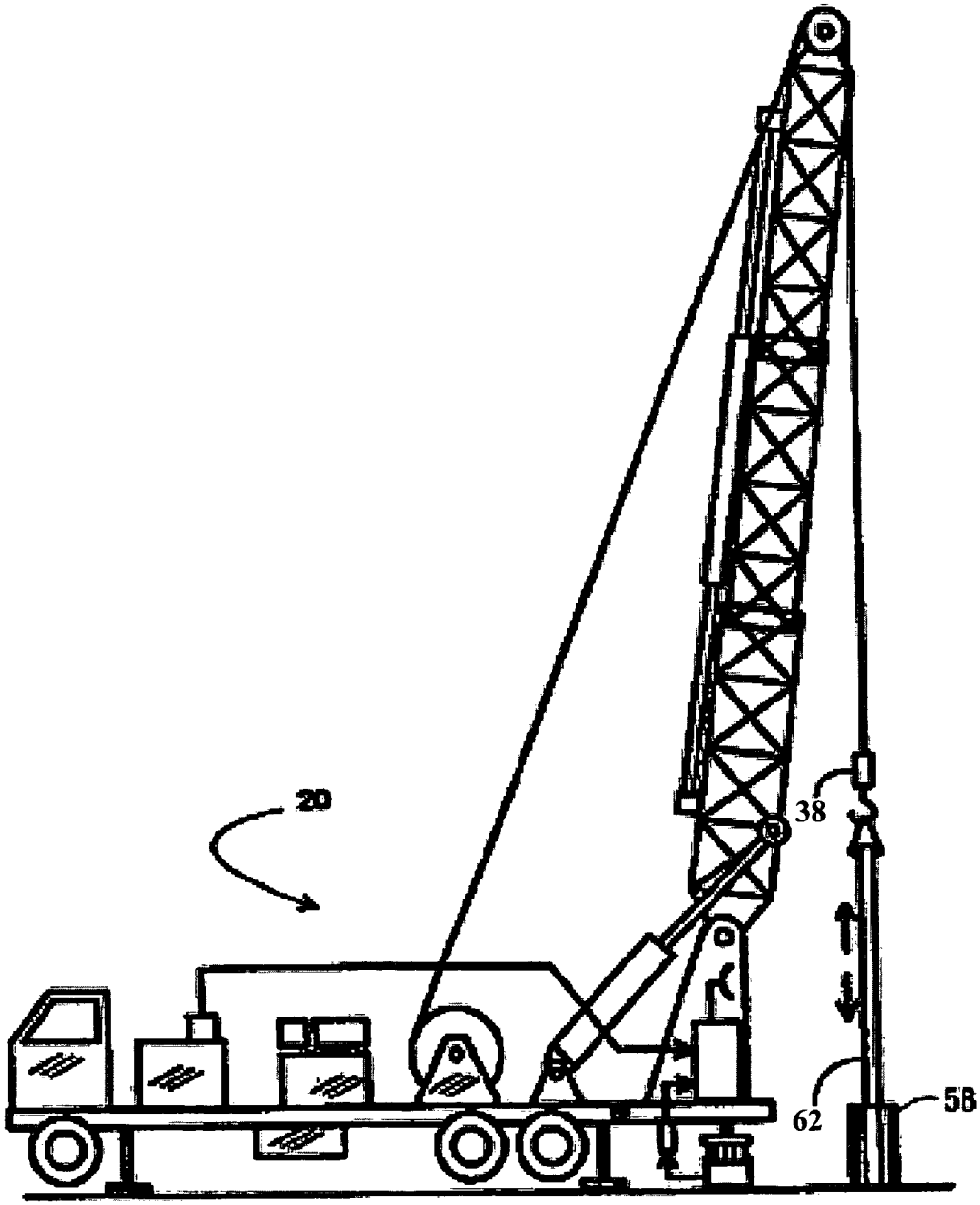
FIG. 3 illustrates the raising and lowering of an inner tubing string with the exemplary service rig according to one exemplary embodiment of the present invention.

Referring to FIG. 1, a retractable, self-contained service rig 20 is shown to include a truck frame 22 supported on wheels 24, an engine 26, a hydraulic pump 28, an air compressor 30, a first transmission 32, a second transmission 34, a variable speed hoist 36, a block 38, an extendible derrick 40, a first hydraulic cylinder 42, a second hydraulic cylinder 44, a monitor 48, retractable feet 50, and an encoder 71. Engine 26 selectively couples to wheels 24 and hoist 36 by way of transmissions 34 and 32, respectively. Engine 26 also drives hydraulic pump 28 via line 29 and air compressor 30 via line 31. Compressor 30 powers a pneumatic slip (not shown), and pump 28 powers a set of hydraulic tongs (not shown). Pump 28 also powers cylinders 42 and 44 that respectively extend and pivot derrick 40 to selectively place derrick 40 in a working position (FIG. 1) and in a retracted position (FIG. 2). In the working position, derrick 40 is pointed upward, but its longitudinal centerline 54 is angularly offset from vertical as indicated by angle 56. This angular offset 56 provides block 38 access to a well bore 58 without interference from the derrick framework and allows for rapid installation and removal of inner pipe segments, such as inner pipe strings, segments, tubing, rods, pipes, piping, etc. 62 (hereinafter "tubing" "segments" or "rods" (FIG. 3).

When installing inner pipe segments 62, the individual pipe segments 62 are screwed together using hydraulic tongs (not shown). Hydraulic tongs are known in the art, and refer to any hydraulic tool that can screw together two pipes 62 or sucker rods 62. During make up operations, block 38 supports each pipe segment 62 while it is being screwed into the downhole pipe string. After that connection, block 38 supports the entire string of pipe segments 62 so that the new pipe segment 62 can be lowered into the well 58. After lowering, the entire string 62 is secured, and the block 38 retrieves another pipe segment 62 for connection with the entire string 62. Conversely, during breakout operations, block 38 raises the entire string of pipe segments 62 out of the ground until at least one individual segment 62 is exposed above ground. The string is secured, and then block 38 supports the pipe segment 62 while it is uncoupled from the string. Block 38 then moves the individual pipe segment 62 out of the way, and returns to raise the string 62 so that further individual pipe segments 62 can be detached from the string 62.

Referring back to FIG. 1, weight applied to block 38 is sensed, for example, by way of a hydraulic pad 92 that supports the weight of derrick 40. Generally, hydraulic pad 92 is a piston within a cylinder, but can alternatively constitute a diaphragm. Hydraulic pressure in pad 92 increases with increasing weight on block 38, and this pressure can accordingly be monitored to assess the weight of the block 38. Other types of sensors can be used to determine the weight on the block 38, including line indicators attached to a deadline of the hoist 36, a strain gage that measures any compressive forces on the derrick 40, or load cells placed at various positions on the derrick 40 or on the crown. While the weight of the block can be measured in any number of ways, the exact means of measurement is not critical to the present invention.

Hoist 36 controls the movement of a cable 37 which extends from hoist 36 over the top of a crown wheel assembly 55 located at the top of derrick 40, supporting traveling block 38. Hoist 36 winds and unwinds cable 37, thereby moving the traveling block 38 between its crown wheel assembly 55 and its floor position, which is generally at the wellbore 58, but can be at the height of an elevated platform located above wellbore 58 (not shown). The position of the traveling block 38 between its crown and floor position must always be monitored.

To monitor the position of the block 38, the system comprises a magnetic pick-up device or other electrical output type sensor, such as an encoder 71 that is operatively situated adjacent to a rotary part of the cable hoist 36 or crown wheel assembly 55 and produces electrical impulses as the part rotates. Alternatively, a photoelectric device is used to generate the necessary electric impulses. These electrical impulses are conveyed to electronic equipment that counts the electrical impulses and associates them with a multiplier value, thereby determining the position of the traveling block. Other methods are just as useful to the present invention, such as a quadrature encoder, an optical quad encoder, a linear 4-20 encoder, or other such devices known in the art.

It is important that the position of the block 38 is measured and known. It is typically even more important for a service rig 20 to know the position of the block 38 than it is for a drilling rig. Drilling rigs pull stands of pipe which are generally uniform in length. While drilling rigs may pull double stands or single stands of pipe, whichever they are doing for that job, they are generally doing the same thing all the time. In addition, drilling rigs do not switch back-and-forth between pulling or inserting tubing and rods.

On the other hand, service rigs 20 typically go from one well to another. Each well may have a different floor height and other characteristics. In addition, the service rig 20 might pull a triple stand of rods that is seventy-five feet long and then, later on, pull a double stand of tubing, which is sixty feet long. Thus, the upper and lower bounds for a service rig 20 raising and lowering rods and tubing may continuously change based on the particular job aspects and characteristics of the well area, and thus, the upper and lower bounds for the block 38 during each particular operation is important to know.

Once the position of the traveling block 38 is known, the speed of the traveling block 38 can be easily calculated by the system described herein. When seeking to prevent crown out, the system first senses the velocity and vertical position of the traveling blocks 38. Depending on which region 104-112 (position) the blocks 38 are in (FIG. 4), the operator evaluates a display 610 (FIG. 6) to determine if the blocks 38 have reached or are about to reach an upper or lower level boundary. This methodology allows the crew to operate at full horsepower pulling heavy loads at full RPM at any point in any region 104-112 so long as the block position data is evaluated and maintained between the upper and lower limits including certain safety ranges.

Figure 4:
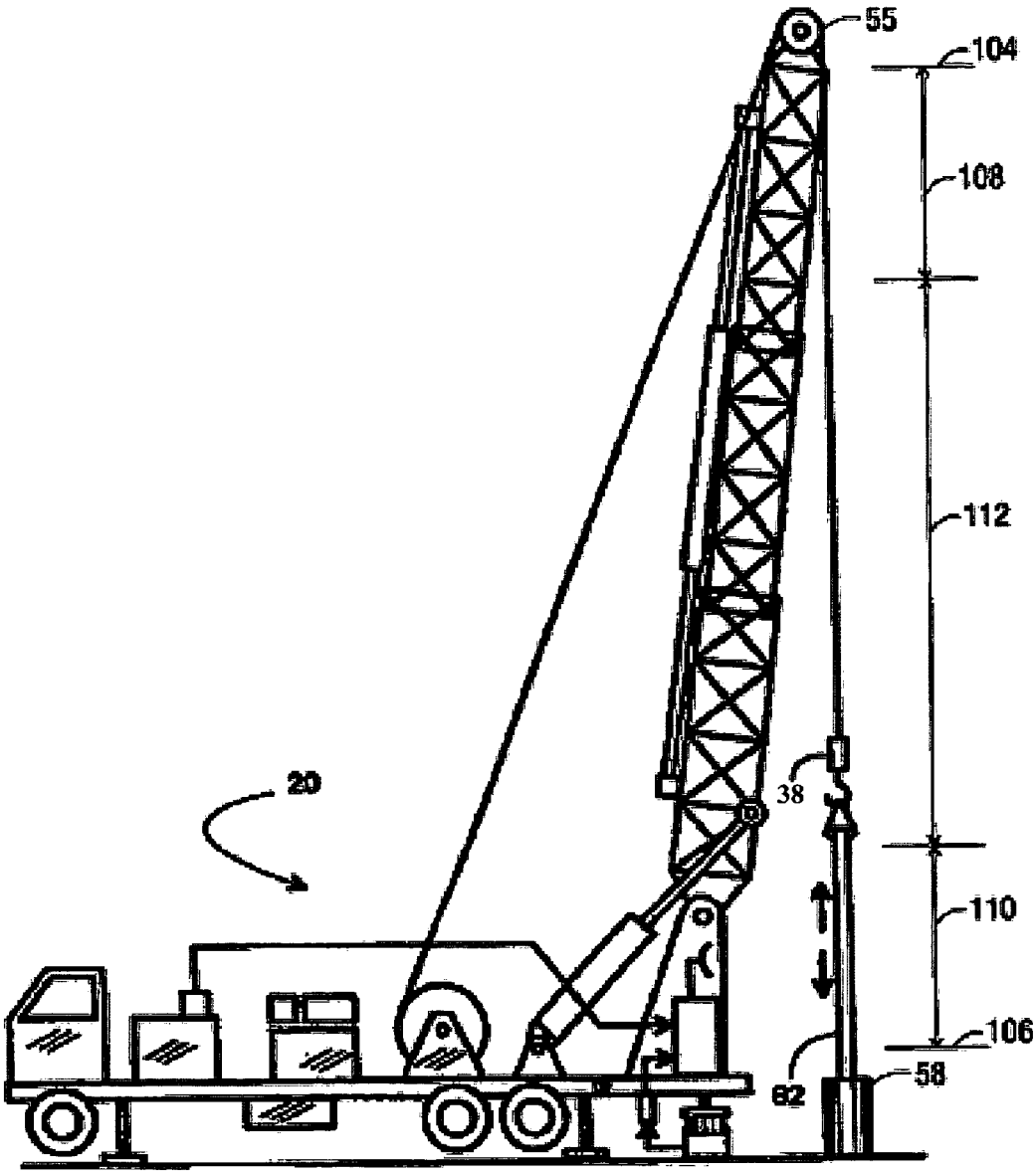
FIG. 4 illustrates another embodiment of the raising and lowering of an inner tubing string with the exemplary service rig according to one exemplary embodiment of the present invention.

Regardless of the block 38 velocity, when the block 38 reaches a predetermined upper limit as shown in FIG. 4 as upper point 104 (Upper Travel Limit), the operator of the rig or the system will stop the traveling block's 38 upward movement, by reducing the engine 26 to an idle, releasing the drum clutch, and setting the drum parking brake. When the block 38 is traveling downward through region 108 and 112, if the velocity is below a predetermined or calculated maximum regional value, based on an evaluation of the encoder velocity data on the display 610, the operator does not have to take any action. When the blocks 38 travel into lower region 110 which is near the lower stopping point 106, the operator of the service rig 20 evaluates the block position data of the block position chart to determine when to stop the block 38 prior to it reaching the lower limit.

Referring now to FIG. 4, a service rig is shown with the block 38 supporting a string of tubing 62. The block's 38 total travel is between the crown of the hoist 55 and the floor at the well head 58. A point before crown out is the upper limit of travel 104 where the traveling block 38 will be completely stopped by the system. A point before floor out is the lower limit of travel 106 where the traveling block 38 will also be completely stopped by the system. A range below the upper limit is the upper protected travel range 108.

Figure 5:
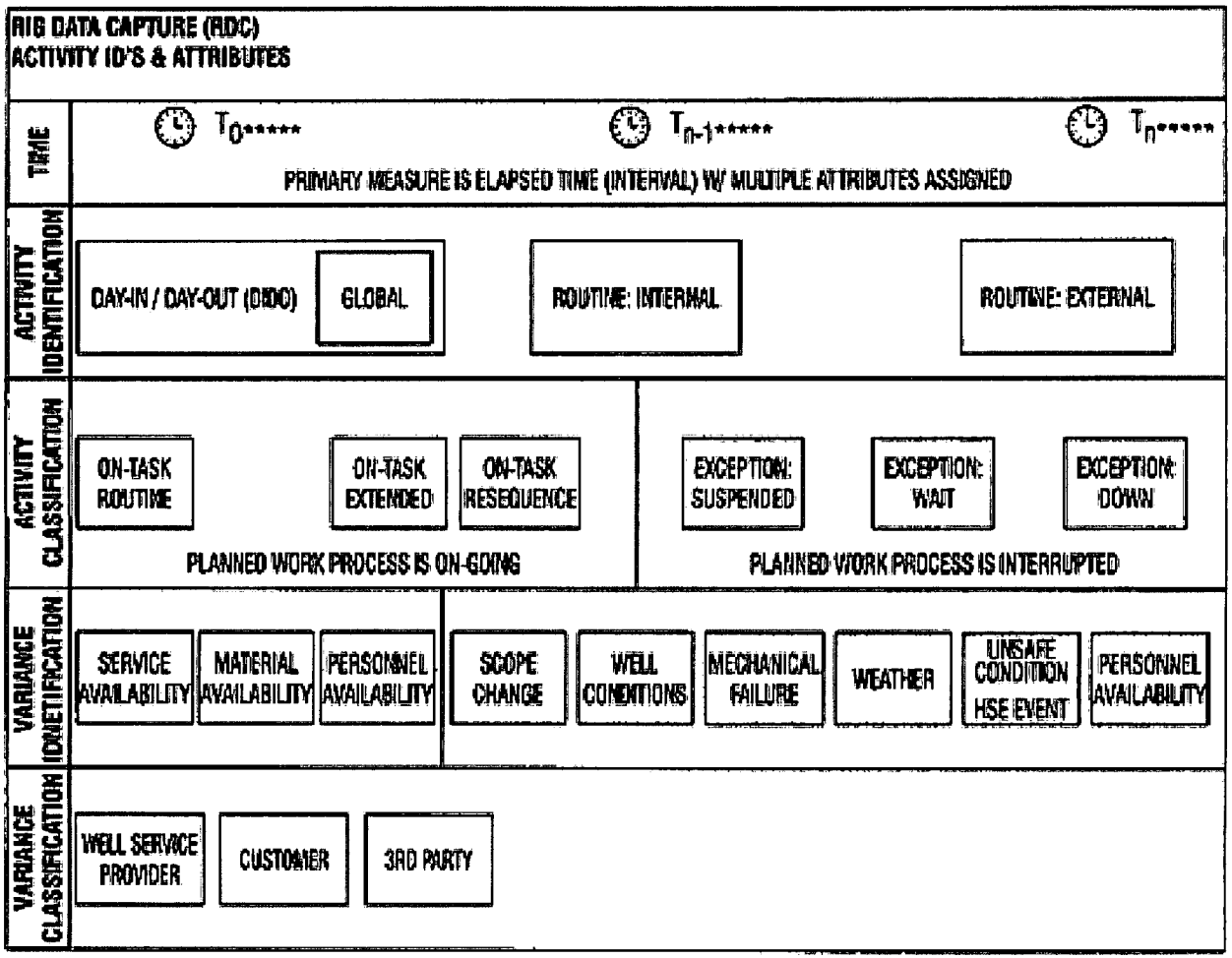
FIG. 5 illustrates one embodiment of an activity capture methodology outlined in tabular form according to one exemplary embodiment of the present invention.

FIG. 5 provides an illustration of an activity capture methodology in tabular form according to one exemplary embodiment of the present invention. Now referring to FIG. 5, an operator first chooses an activity identifier for his/her upcoming task. If "GLOBAL" is chosen, then the operator would choose from rig up/down, pull/run tubing or rods, or laydown/pickup tubing and rods (options not shown in FIG. 5). If "ROUTINE: INTERNAL" is selected, then the operator would choose from rigging up or rigging down an auxiliary service unit, longstroke, cut paraffin, nipple up/down a BOP, fishing, jarring, swabbing, flowback, drilling, clean out, well control activities such as killing the well or circulating fluid, unseating pumps, set/release tubing anchor, set/release packer, and pick up/laydown drill collars and/or other tools. Finally, if "ROUTINE: EXTERNAL" is chosen, the operator would then select one an activity that is being performed by a third party, such as rigging up/down third party servicing equipment, well stimulation, cementing, logging, perforating, or inspecting the well, and other common third party servicing tasks. After the activity is identified, it is classified. For all classifications other than "ON TASK: ROUTINE," a variance identifier is selected, and then classified using the variance classification values.

Figure 6:
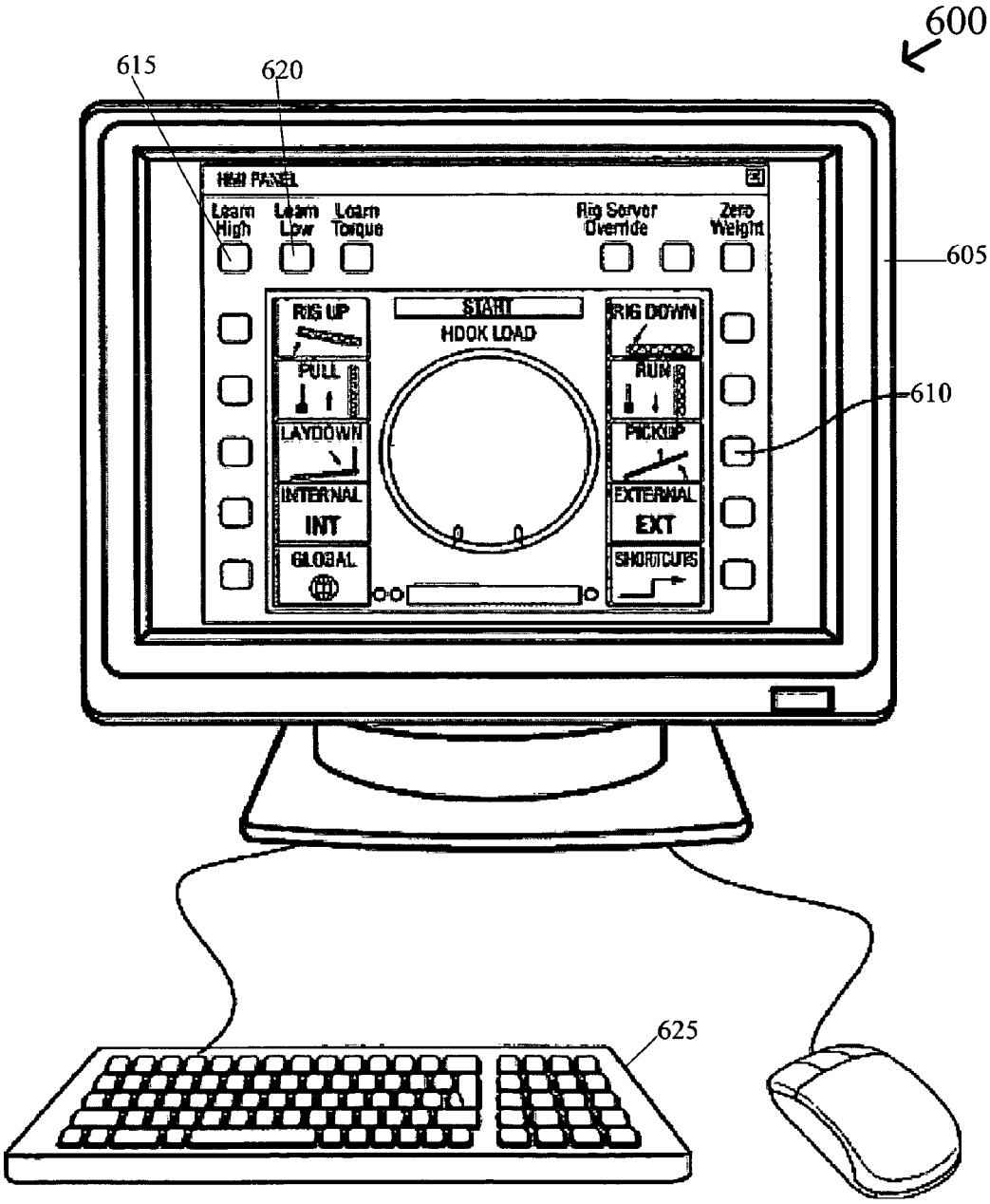
FIG. 6 provides a frontal view of an exemplary operator interface according to one exemplary embodiment of the present invention.

FIG. 6 provides a view of an rig operator interface or supervisor interface according to one exemplary embodiment of the present invention. Now referring to FIG. 6, all that is required from the operator is that he or she enter in the activity data into a computer 605. The operator can interface with the computer 605 using a variety of means, including typing on a keyboard 625 or using a touch-screen 610. In one embodiment, a display 610 with pre-programmed buttons, such as 615, 620, is provided to the operator, as shown in FIG. 6, which allows the operator to simply select the activity from a group of pre-programmed buttons. For instance, if the operator were presented with the display 610 of FIG. 6 upon arriving at the well site, the operator would first press the "RIG UP" button. The operator would then be presented with the option to select, for example, "SERVICE UNIT," "AUXILIARY SERVICE UNIT," or "THIRD PARTY." The operator then would select whether the activity was on task, or if there was an exception, as described above. In addition, as shown in FIG. 6, prior to removing or inserting tubing 62, the operator could set the high and low limits for the block 38 by pressing the learn high 615 or learn low 620 buttons after moving the block 38 into the proper position.

Figure 7:
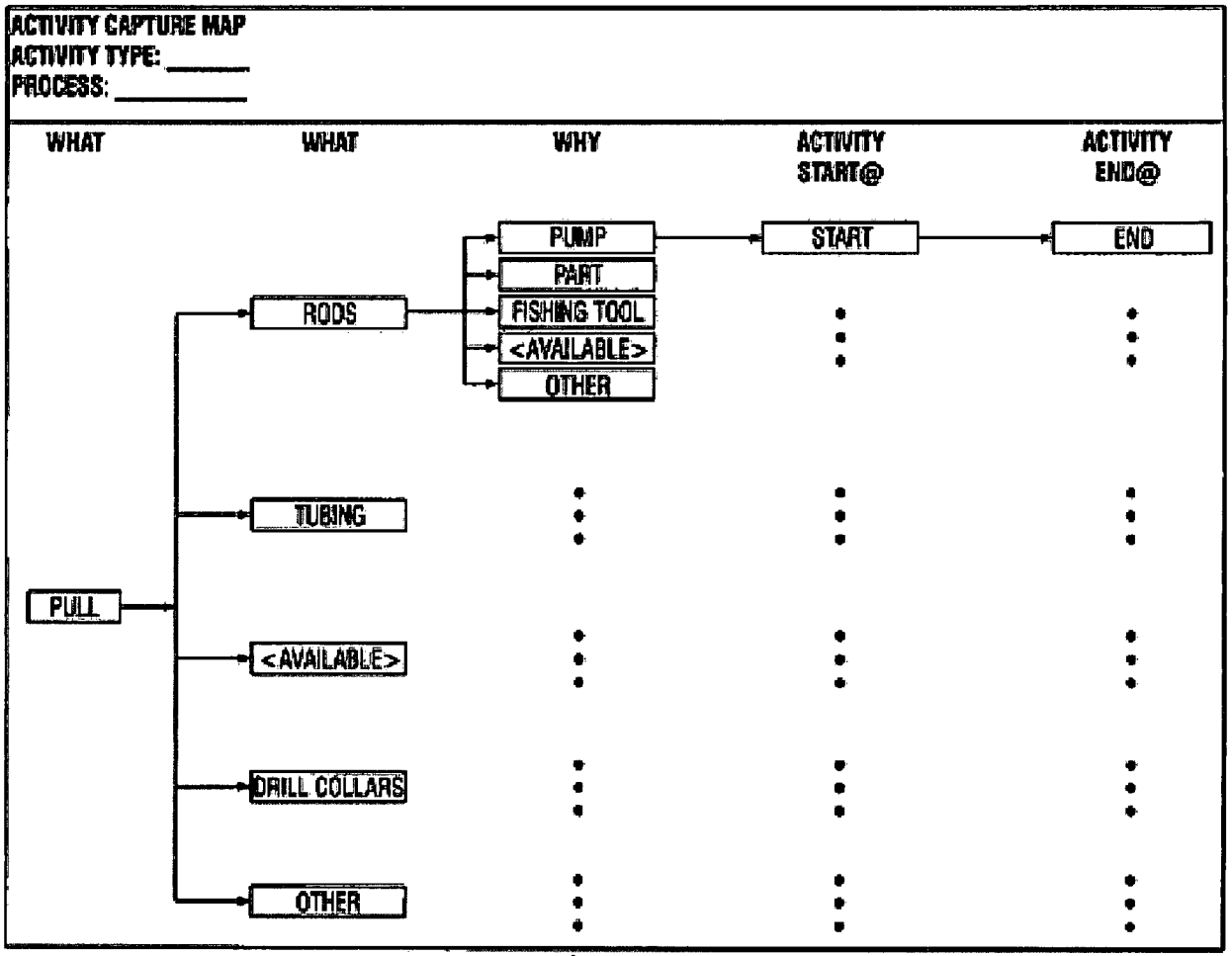
FIG. 7 provides an illustration of an exemplary activity capture map according to one exemplary embodiment of the present invention.

An example of an activity capture map for pulling operations is shown in FIG. 7. If an operator were to select "PULL"

from the top screen, he would then have the option to select between "RODS," "TUBING," "DRILL COLLARS," or "OTHER." If the operator chose "RODS," the operator would then choose from "PUMP," "PART," "FISHING TOOL," or "OTHER." The operator would be trained on the start and stop times for each activity, as shown in the last two columns of FIG. 7, so that the operator could appropriately document the duration of the activity at the well site. Each selection would have its own subset of tasks, as described above, but for ease of understanding, only those pulling rods are shown in FIG. 7.

Figure 8:
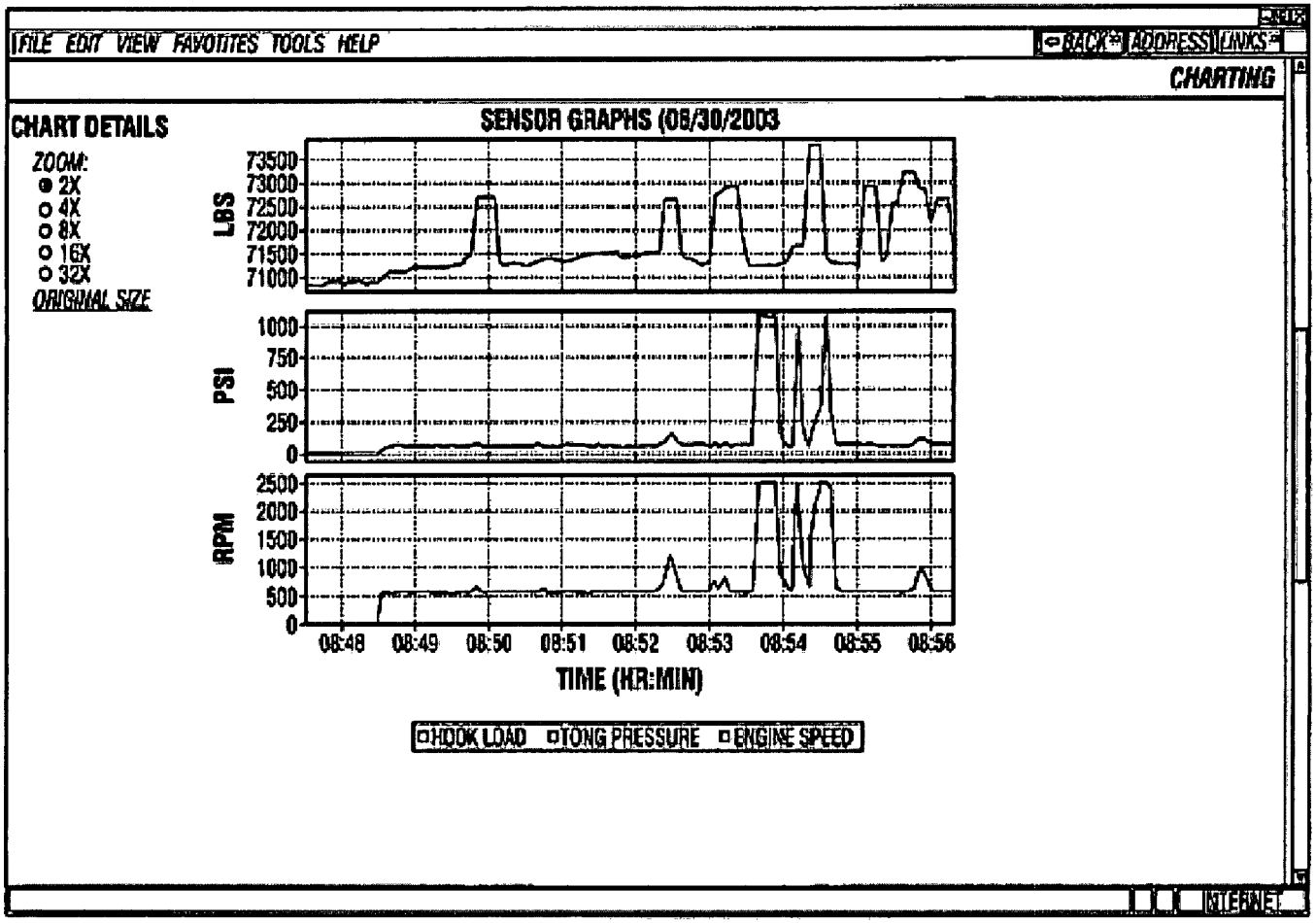
FIG. 8 provides an illustration of an exemplary sensor data display for viewing by a rig operator or supervisor according to one exemplary embodiment of the present invention.

Finally, as shown in greater detail in FIG. 8, the web user can select certain transducer data to view on the web page. For example, in FIG. 8 hook load in pounds, tong pressure in pounds per square inch, and engine speed in rpm are shown as a function of rig time. The operator, well service provider, the customer, or other third party can use this data, in some embodiments in conjunction with the activity information, to determine if the well service operations were efficient and performed correctly. This is a very valuable tool for increasing efficiency and productivity of well servicing operations, as well as providing the customer with information that they are getting their moneys worth from their well service provider.

Processes of exemplary embodiments of the present invention will now be discussed with reference to FIGS. 9, 11, 12, and 15. Certain steps in the processes described below must naturally precede others for the present invention to function as described. However, the present invention is not limited to the order of the steps described if such order or sequence does not alter the functionality of the present invention in an undesirable manner. That is, it is recognized that some steps may be performed before or after other steps or in parallel with other steps without departing from the scope and spirit of the present invention.

Figure 9:
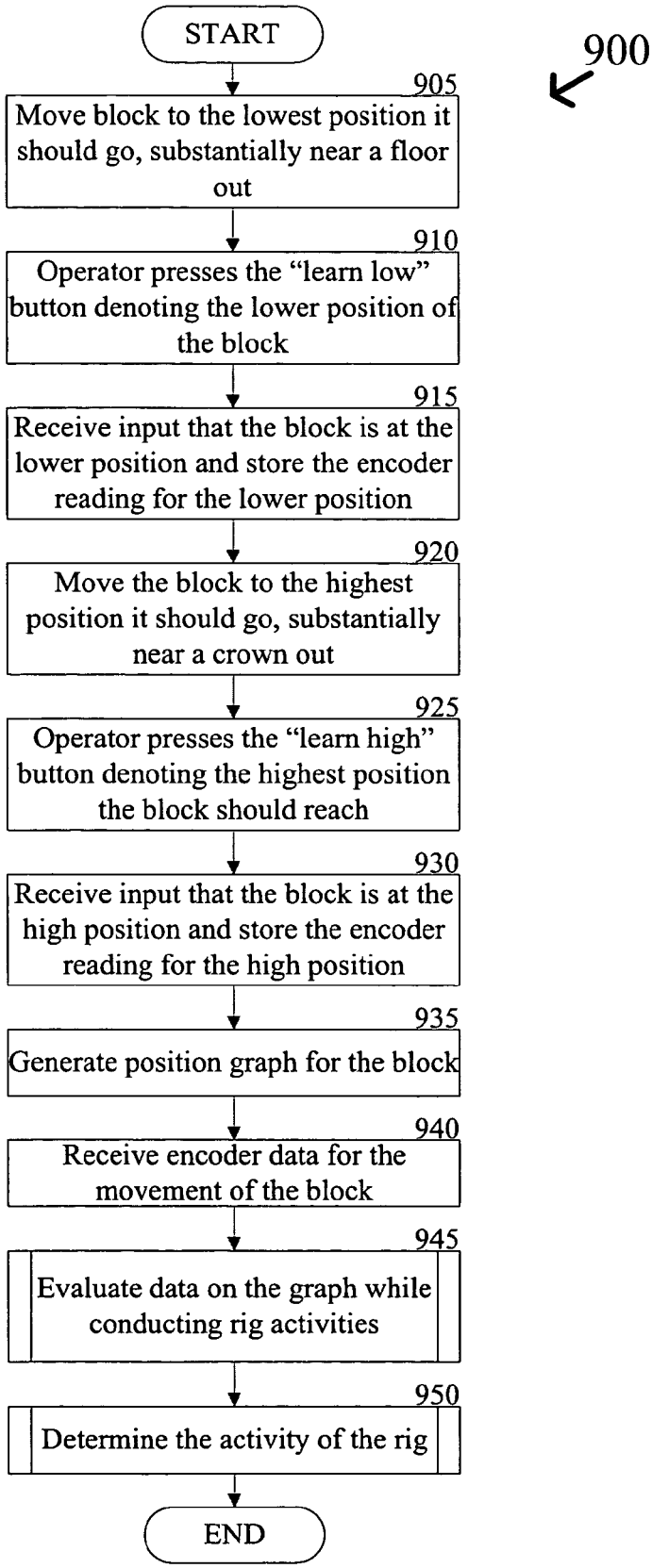
FIG. 9 is a flowchart of an exemplary process for evaluating block position on a service rig by evaluating block position data on a display according to one exemplary embodiment of the present invention.

FIG. 9 is a logical flowchart diagram illustrating an exemplary method 900 for evaluating block position on a service rig 20 by evaluating block position data on a block position chart 1005 on a display 610. Now referring to FIGS. 1, 6, 9, and 10, the exemplary method 900 begins at the START step and continues to step 905 where an operator of a service rig 20 positions a block 38 at the lowest point that the operator wants the block 38 to go, which is near the floor-out position. In step 910, the operator presses the "learn low" button 620 on the display 610. An input is received at the monitoring system 600 that the block 38 is at the lower position and the current reading for the encoder 71 is stored at the monitoring system 600 in step 915.

In step 920, the operator of the service rig 20 moves the block 38 to the highest position that it should go along the derrick 40, which is near the crown-out point. In step 925, the operator presses the "learn high" button 615 on the display 610. An input is received at the monitoring system 600 that the block 38 is at the high position and the monitoring system stores the number of encoder pulses from the tubing drum 36 between the high and low positions and the position of the encoder 71 at the high position in step 930. In step 935, the monitoring system 600 generates a block position graph 1005 for the current operation of the block 38.

Pulses are received from the encoder 71 during the operation of the tubing drum 36 on the service rig 20 and transmitted via well known electrical methods to the monitoring system 600 in step 940. In step 945, the operator evaluates the data chart 1005 on the display 610 to determine what actions to take regarding the raising and lowering of the block 38 during operation of the tubing drum 36. In step 950, the activities of the service rig 20 are evaluated by evaluating the data chart 1005 of block position data. The process then continues from step 950 to the END step.

Figure 10:
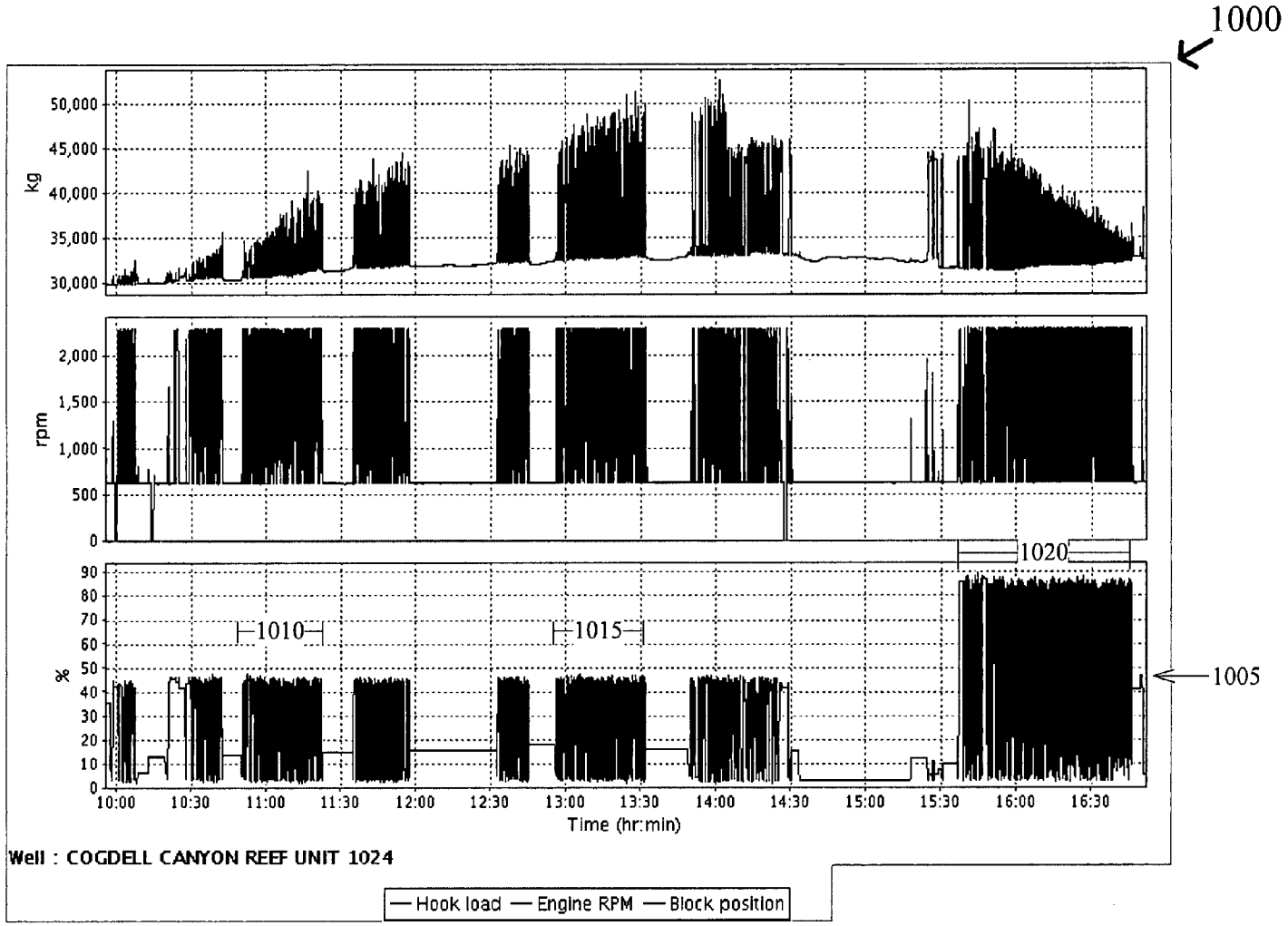
FIG. 10 provides an illustration of an exemplary display of block position data curves provided to an operator on a display according to one exemplary embodiment of the present invention.

FIG. 10 provides an exemplary display of block position data curves provided to an operator on a display 610 at a monitoring system 600. Now referring to FIGS. 1, 6, and 10, the exemplary display 1000 includes a block position data chart 1005. The X-axis of the block position data chart 1000 represents time and the Y-axis represents the percentage of the pulses from the encoder 71 that the block 38 has completed on it way to a predetermined position. In one exemplary embodiment, one hundred percent represents the "learn high" position input by the operator and zero percent represents the "learn low" position input by the operator at the display 610. As stated above, the 0-100 scale represents where the block 38 is at any time based on the scale as it relates to the set points input by the operator. Activities can be determined by evaluating the data presented in the block position data chart 1005. For example, in the exemplary chart 1005 several actions representing one or more activities are apparent to those of ordinary skill in the art, including actions denoted with bracketing as 1010, 1015, and 1020. An evaluation of actions 1010 and 1015 on the chart 1005 reveal that the block 38 is repetitively moving up and down. As it moves down, the block 38 is stopping at a low point, or trough in the data, at or near zero percent. As it moves up in actions 1010 and 1015, the block 38 is stopping, or peaking, at or near forty-seven percent. From a review of this data on the chart 1005, it is apparent that the service rig 20 is picking up tubing 62 off of the ground. This can be determined because the block position data curve indicates that the block 38 is only going about half way up the derrick 40 for each lifting interval.

An evaluation of action 1020 on the chart 1005 reveals that the block 38 is repetitively moving up and down, stopping at a low point near zero percent and stopping at a high point for each cycle near eighty-five percent. From a review of this data on the chart 1005, it is apparent that the service rig 20 is pulling tubing 62 out of a well and racking it in the derrick 40.

Figure 11:
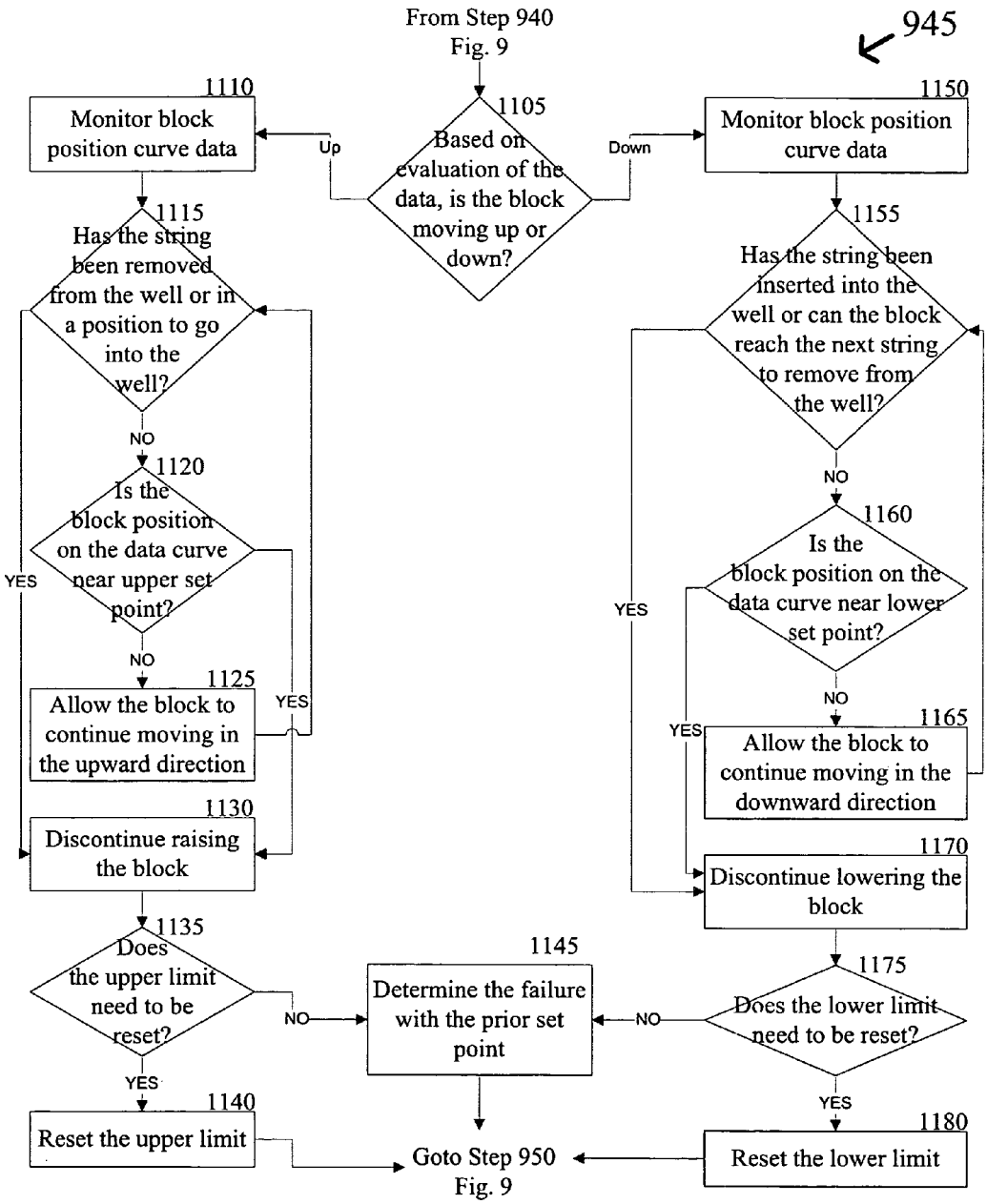
FIG. 11 is a flowchart of an exemplary process for evaluating a display of block position data to determine the block position on a service rig during operation of the rig according to one exemplary embodiment of the present invention.

FIG. 11 is a logical flowchart diagram illustrating an exemplary method 945 for determining the block 38 position on a service rig 20 to determine the actions to be taken with respect to raising or lowering the block 38 by evaluating block position data on a block position chart 1005 on a display 610. Now referring to FIGS. 1, 6, 10, and 11, the exemplary method 945 begins at step 1105 where an inquiry is conducted to determine if the block 38 is moving up or down based on an evaluation of the block position data on the block position data chart 1005. In one exemplary embodiment, if the data curve on the block position data chart 1005 is trending downward, towards zero percent, then the block is moving in the down direction, and if the data curve on the block position data chart 1005 is trending upward, towards one hundred percent, then the block 38 is being raised. In an alternative embodiment, the direction of the block 38 is determined based on an evaluation of block velocity (not shown).

If it is determined that the block 38 is moving upward, the "Up" branch is followed to step 1110, where the operator of the service rig 20 continues to monitor the data from the block position chart 1005. In step 1115, an inquiry is conducted to determine if the string of tubing 62 has been completely removed from the well 58 or a string of tubing 62 is ready to go in the well 58. If so, the "YES" branch is followed to step 1130. Otherwise, the "NO" branch is followed to step 1120. In step 1120, an inquiry is conducted to determine if the block position on the data curve is near the learned high point. In one exemplary embodiment, the operator makes this determination by evaluating if the block position on the chart 1005 is above eighty-five percent. If the block 38 is not substantially near the learned high point, the "NO" branch is followed to step 1125, where the operator allows the block 38 to continue moving in the upward direction. The process then returns to step 1115. On the other hand, if the block 38 is substantially near the learned high point on the chart 1005, the "YES" branch is followed to step 1130, where the operator discontinues raising the block 38.

In step 1135, an inquiry is conducted to determine if the "learn high" limit needs to be reset. In one exemplary embodiment, the "learn high" limit may need to be reset if the operator is not able to fully remove a string of tubing 62 from a well 58 without approaching the learned high position too closely on the chart 1005. If the "learn high" limit needs to be reset, the "YES" branch is followed to step 1140, where the operator resets the "learn high" position by raising the block 38 to a new high position and pressing the learn high button 615 on the display 610. The process then continues from step 1140 to step 950 of FIG. 9. On the other hand, if the learned high position does not need to be reset, the "NO" branch is followed to step 1145 for an evaluation of why the operator approached learned high position without the tubing 62 being fully removed from the well 58 or ready to be placed into the well 58. The process then continues from step 1145 to step 950 of FIG. 9.

Returning to step 1105, if it is determined that the block 38 is being lowered, the "Down" branch is followed to step 1150, where the operator of the service rig 20 continues to monitor the data from the block position chart 1005. In step 1155, an inquiry is conducted to determine if the string of tubing 62 has been completely inserted into the well 58 or if a string of tubing 62 is ready to be removed from the well 58. If so, the "YES" branch is followed to step 1170. Otherwise, the "NO" branch is followed to step 1160. In step 1160, an inquiry is conducted to determine if the block position on the data curve is near the learned low point. In one exemplary embodiment, the operator makes this determination by evaluating if the block position on the chart 1005 is below ten percent. If the block 38 is not substantially near the learned low point, the "NO" branch is followed to step 1165, where the operator allows the block to continue being lowered. The process then returns to step 1155. On the other hand, if the block 38 is substantially near the learned low point on the chart 1005, the "YES" branch is followed to step 1170, where the operator discontinues lowering the block 38.

In step 1175, an inquiry is conducted to determine if the "learn low" limit needs to be reset. In one exemplary embodiment, the "learn low" limit may need to be reset if the operator is not able to fully insert a string of tubing 62 into a well 58 without approaching the learned low position too closely on the chart 1005. If the "learn low" limit needs to be reset, the "YES" branch is followed to step 1180, where the operator resets the "learn low" position by lowering the block 38 to a new low position and pressing the learn low button 620 on the display 610. The process then continues from step 1180 to step 950 of FIG. 9. On the other hand, if the learned low position does not need to be reset, the "NO" branch is followed to step 1145 for an evaluation of why the operator approached learned low position without the tubing 62 being fully inserted into the well 58 or ready to be removed from the well 58. The process then continues from step 1145 to step 950 of FIG. 9.

Figure 12:
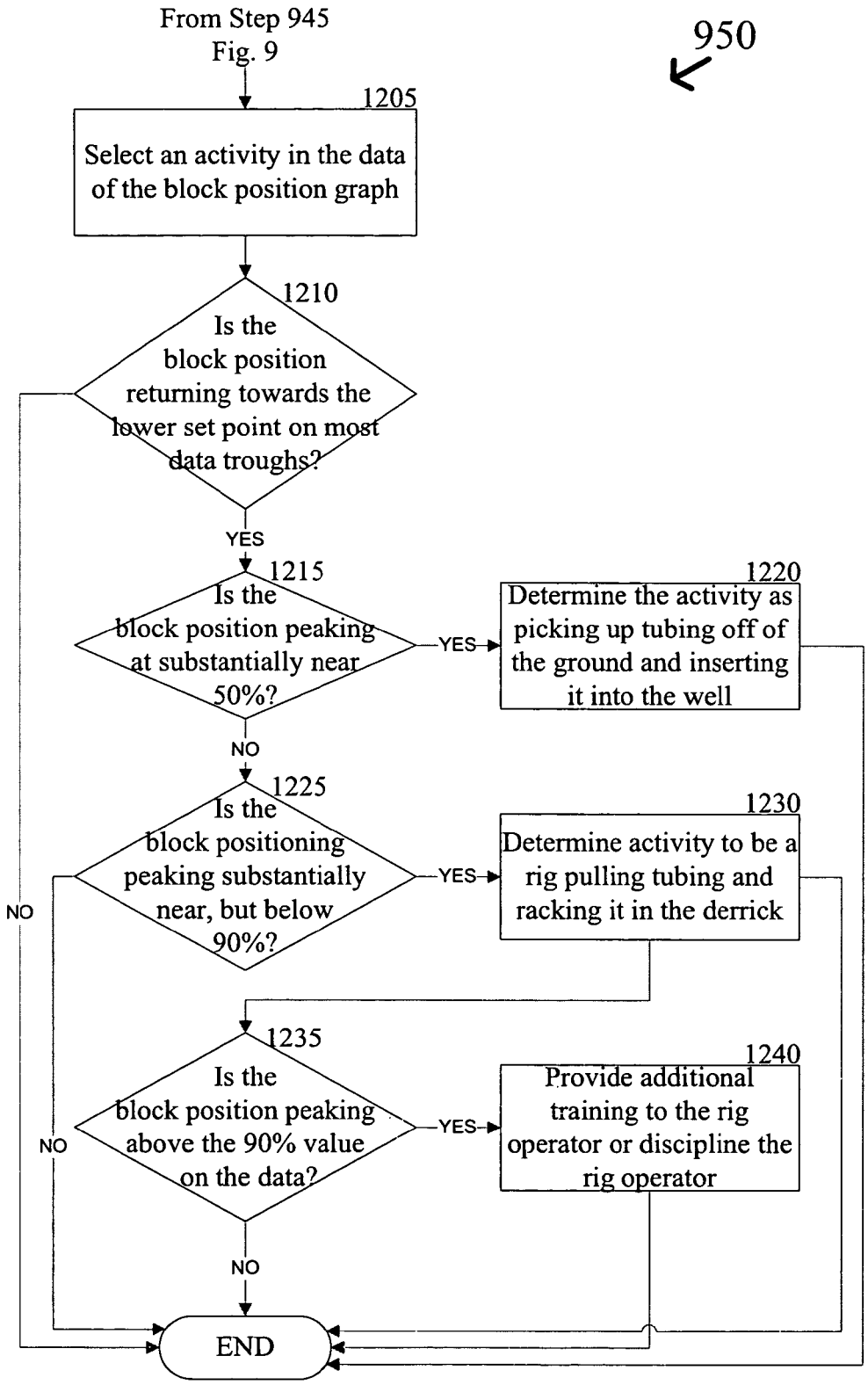
FIG. 12 is a flowchart of an exemplary process for evaluating a display of block position data to determine activities that were occurring with the service rig according to one exemplary embodiment of the present invention.

FIG. 12 is a logical flowchart diagram illustrating an exemplary method 950 for determining the activities that occurred on a service rig 20 by evaluating block position data on the block position chart 1005 on the display 610. Now referring to FIGS. 1, 6, 10, and 12, the exemplary method 950 begins at step 1205 where an activity is selected from the block position data on the chart 1005. In step 1210, an inquiry is conducted to determine if, by evaluating the data on the chart 1005, the block position is returning substantially towards the learned low set point on most troughs of the data. In one exemplary embodiment, the data is returning substantially towards the learned low set point if the trough of the data is approximately five percent on the chart 1005. If the position at the trough is not substantially near the learned low point, the "NO" branch is followed to the END step. Otherwise, the "YES" branch is followed to step 1215.

In step 1215, an inquiry is conducted to determine if the peaks of the block position data on the chart 1005 for the selected activity are substantially near fifty percent. In one exemplary embodiment, the peaks are substantially near fifty percent if a majority of the peaks for an activity are in a range of forty-two to fifty-five percent. If the block position data peaks are substantially near fifty percent, the "YES" branch is followed to step 1220, where the supervisor, or third party determines that the activity being accomplished by the rig 20 is picking up tubing 62 off of the ground and inserting it into the well 58. The process then continues from step 1220 to the END step. On the other hand, if the block position data peaks are not substantially near fifty percent, the "NO" branch is followed to step 1225.

In step 1225, an inquiry is conducted to determine if the peaks of the block position data on the chart 1005 for the selected activity, for example activity 1020, are substantially near but below ninety percent. In one exemplary embodiment, the peaks are substantially near but below ninety percent if a majority of the peaks for an activity are in a range of eighty to eight-nine percent. If the block position data peaks are substantially near but below ninety percent, the "YES" branch is followed to step 1230, where the supervisor, or third party determines the rig 20 was pulling tubing 62 from the well 58 and racking it in the derrick 40. The process then continues from step 1230 to the END step. On the other hand, if the block position data peaks are not substantially near but below ninety percent, the "NO" branch is followed to step 1235.

In step 1235, an inquiry is conducted to determine if the peaks of the block position data on the chart 1005 for the selected activity, for example activity 1020, are above ninety percent of the learned high position. If so, the "YES" branch is followed to step 1240, where additional training is provided to the rig operator or the rig operator may be disciplined for raising the block 38 too closely to the crown-out position. The process then continues from step 1240 to the END step. On the other hand, if the peaks of the block position data are not exceeding ninety percent, the "NO" branch is followed to the END step.

Figure 13:
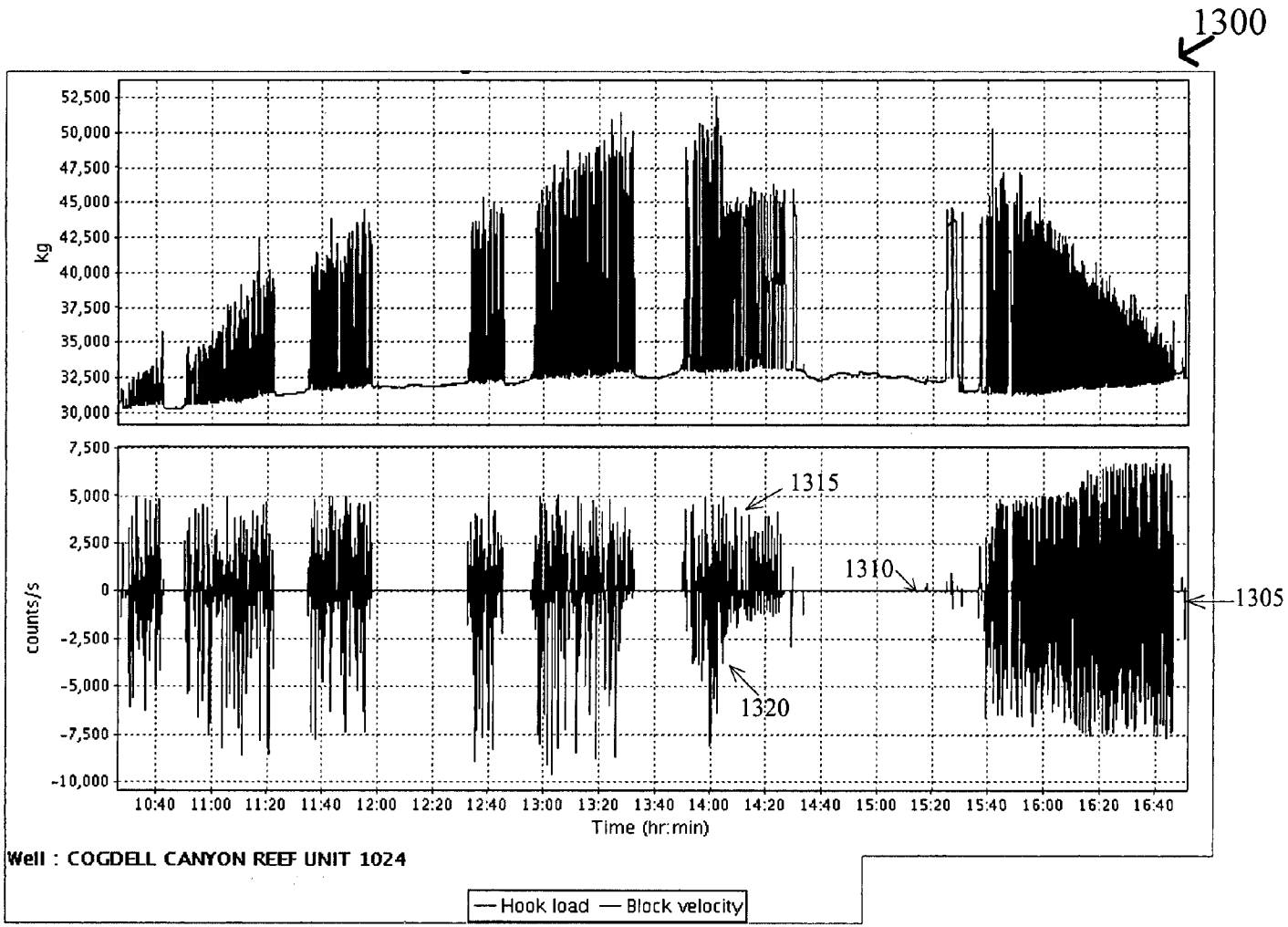
FIG. 13 provides an illustration of an exemplary display of an encoder velocity graph for evaluating the speed of a block on a service rig according to one exemplary embodiment of the present invention.
Figure 14:
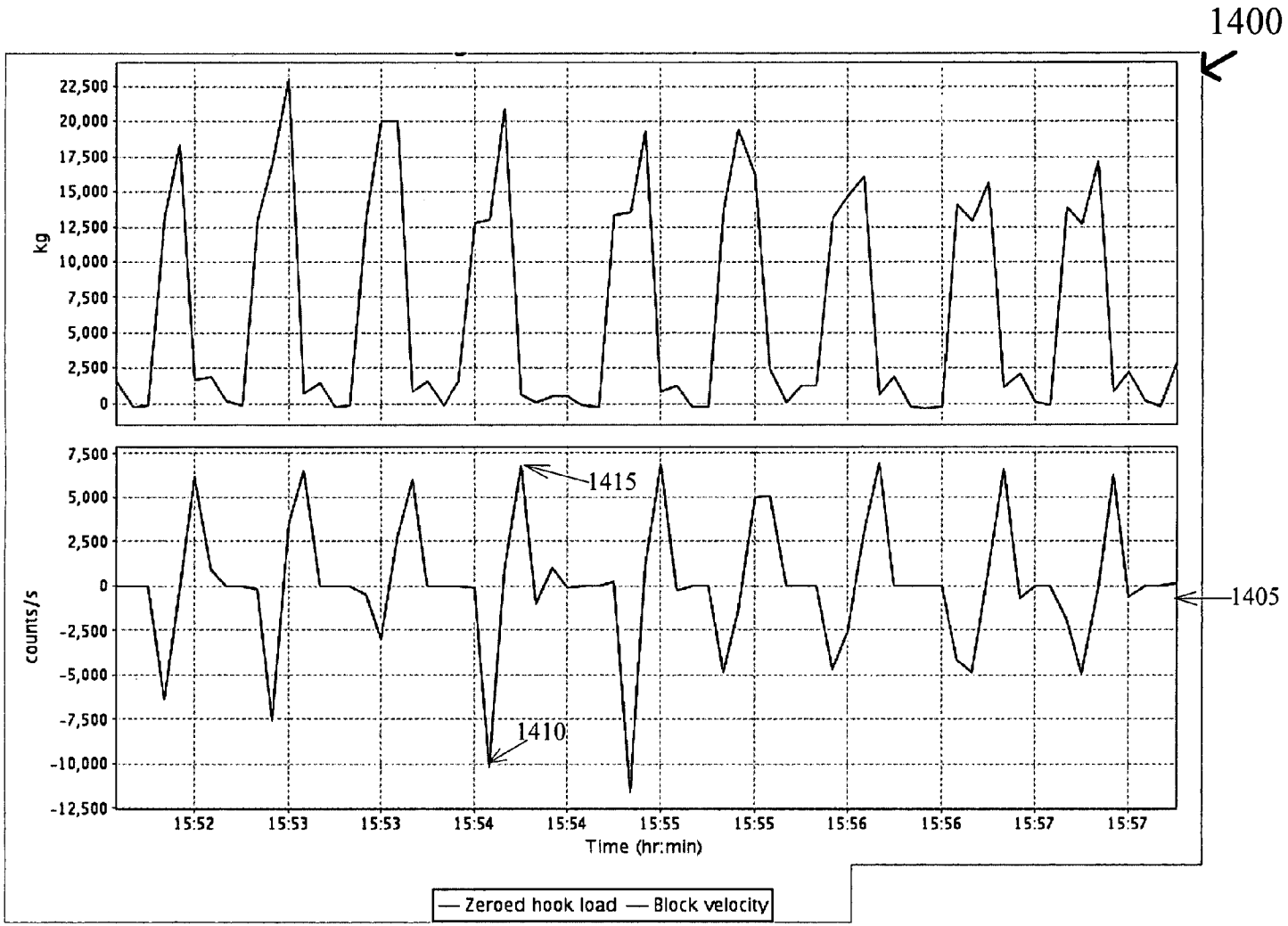
FIG. 14 provides another illustration of the exemplary display of an encoder velocity graph for evaluating the speed of a block on a service rig according to one exemplary embodiment of the present invention.

Turning now to FIGS. 13 and 14, illustrations of exemplary displays 1300 and 1400 of encoder velocity charts for evaluating the speed of a block 38 on a service rig 20 are shown and described according to one exemplary embodiment of the present invention. Now referring to FIGS. 1, 6, 13, and 14, the exemplary display 1300 can be viewed on the display 610 and can include an encoder velocity chart 1305. The X-axis of the encoder velocity chart 1305 represents time and the Y-axis represents the number of pulse counts from the encoder 71 for a specific time period, in this example it is counts per second; however, those of ordinary skill in the art will recognize that other time periods may be used.

The chart 1305 is also capable of providing information as to the direction of the encoder 71 movement. For example, the chart 1305 includes a zero count line 1310. Data counts above the zero count line 1310, such as those represented by 1315, represent the encoder 71 receiving pulse readings in one direction while data counts below the line 1310, such as those represented by 1320, represent the encoder receiving pulse readings in another direction. In one exemplary embodiment, positive pulse count data on the chart 1305 indicates that the block 38 is ascending, while negative pulse count data indicates that the block 38 is descending, however the positive/negative affiliations could easily be swapped without being outside the scope of this invention. In addition, in one exemplary embodiment, a reading of zero on the chart 1305 indicates that the block 38 is stopped and is neither ascending or descending.

The operator of the service rig 20, supervisor or other third party can zoom in on the data in the chart 1305, as shown in the exemplary display 1400 of FIG. 14. In the chart 1405 of FIG. 14, the operator is able to better analyze individual peak 1415 and trough 1410 data points in order to analyze the block speed from an analysis of the encoder velocity graph 1405.

Figure 15:
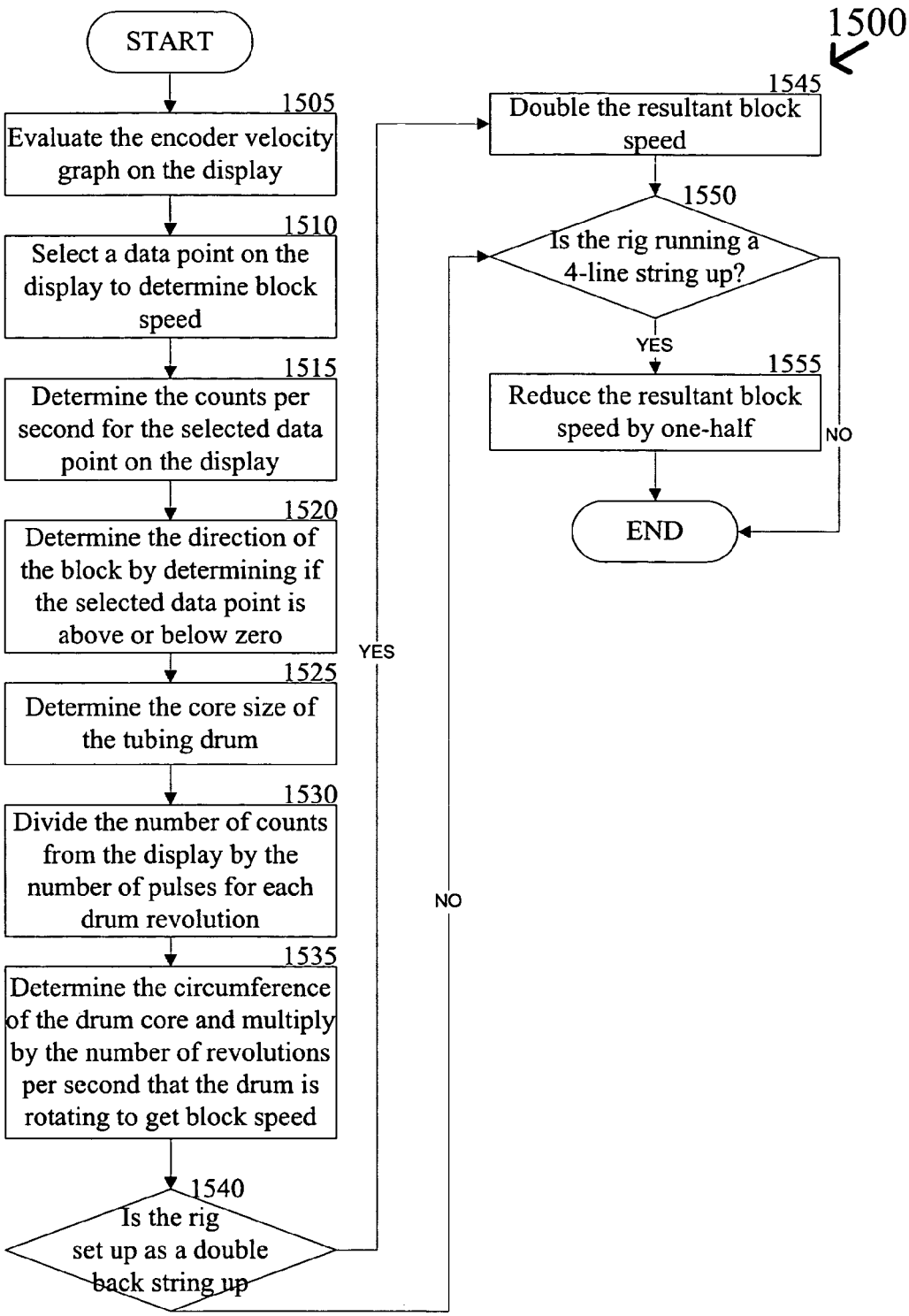
FIG. 15 is a flowchart of an exemplary process for evaluating a display of encoder velocity and determining a block speed of a block on a service rig according to one exemplary embodiment of the present invention.

FIG. 15 is a logical flowchart diagram illustrating an exemplary method 1500 for determining the speed of a block 38 on a service rig 20 by evaluating encoder velocity data on an encoder velocity chart 1405 on a display 610. Now referring to FIGS. 1, 6, 14, and 15, the exemplary method 1500 begins at the START step and continues to step 1505 where an operator, supervisor, or other third party evaluates the encoder velocity graph 1405 on the display 610. In step 1510, the evaluator selects an encoder velocity data point on the chart 1405 to determine the speed of the block 38. In one exemplary embodiment, the evaluator may select a peak of the encoder velocity data, such at peak 1415.

The evaluator determines the counts per time period for the selected encoder velocity data point on the chart 1405 in step 1515. In one exemplary embodiment, the peak 1415 has a velocity count of approximately 7000 counts per second. Those of ordinary skill in the art will recognize that by zooming in further on the data on the chart 1405 in the display device 610, a more accurate encoder velocity data count may be obtained. In step 1510, the evaluator determines the direction the block 38 is moving by evaluating the chart 1405 to determine if the selected data point 1415 is above or below zero. In this exemplary embodiment, the data point 1415 is above zero and, based on the prior exemplary information, since it is above zero the evaluator knows that the block 38 is ascending.

In step 1525, the evaluator determines the core size of the tubing drum 36 to determine the circumference of the drum 36 spooling the cable 37. In one exemplary embodiment, the core size or diameter of the drum 36 is two feet. The evaluator divides the number of counts from the selected data point 1415 by the number of pulses registered at the encoder 71 for each revolution of the drum 36 in step 1530. In one exemplary embodiment, the encoder 71 registers 1440 pulses for each revolution of the drum 36. In this exemplary embodiment, the result would be approximately 4.86 revolutions per second.

In step 1535, the evaluator determines the circumference of the drum core based on the diameter of the drum core and multiplies the number of revolutions per time period by the circumference of the drum core. In the exemplary embodiment described above, the circumference of approximately 6.28 feet is multiplied by 4.86 revolutions per second to achieve a result of 30.5 feet per second. In step 1540, an inquiry is conducted to determine if the rig 20 is set up with a double back string up. If so, the "YES" branch is followed to step 1545, where the product for the block speed is doubled because, during a double back set-up the spool off the drum 36 is twice as fast as the rotational speed of the drum 36. If a double back rig set-up is not in use, the "NO" branch is followed to step 1550.

In step 1550, an inquiry is conducted to determine if the rig 20 is running a four line string up. While the exemplary embodiment discusses calculating block 38 speed for four line and double back set-ups, those or ordinary skill in the art will recognize that the rig 20 could alternatively incorporate a six line or eight line string up and those of ordinary skill in the art would be capable, without need for experimentation, to calculate the block 38 speed by knowing the ratios for the differing string ups and configuration of the rig 20. Blocks 38 using a four line string up have a two-to-one mechanical advantage over the drum 36 and therefore, the speed of the block 38 is only half of the speed of the cable 37 spooling off of the drum 36. If the rig 20 is using a four line string up for the block 38, the "YES" branch is followed to step 1555, where the product of the block speed is divided by two to generate the actual block speed. The process continues from step 1555 to the END step. On the other hand, if the rig 20 is not using a four line string up, the "NO" branch is followed to the END step.

Although the invention is described with reference to a preferred embodiment, it should be appreciated by those skilled in the art that various modifications are well within the scope of the invention. Therefore, the scope of the invention is to be determined by reference to the claims that follow. From the foregoing, it will be appreciated that an embodiment of the present invention overcomes the limitations of the prior art. Those skilled in the art will appreciate that the present invention is not limited to any specifically discussed application and that the embodiments described herein are illustrative and not restrictive. From the description of the exemplary embodiments, equivalents of the elements shown therein will suggest themselves to those or ordinary skill in the art, and ways of constructing other embodiments of the present invention will suggest themselves to practitioners of the art. Therefore, the scope of the present invention is to be limited only by any claims that follow.

I claim:

1. A method for determining an activity completed by a rig by analyzing a block position data chart comprising block position data, comprising the steps of:

evaluating a display of block position data on the block position data chart;

identifying a plurality of block position data on the block position data chart as a first activity; and determining the first activity for the rig by comprising the steps of:

evaluating the plurality of block position data wherein the block position data comprises a plurality of peaks and troughs along a curve representing a position of a block;

evaluating the display of block position data to determine if substantially all of the troughs for the first activity on the data curve are substantially near a first predetermined point;

evaluating the display of block position data to determine if substantially all of the peaks for the first activity on the data curve are substantially near a second predetermined point based on a positive determination that the substantially all of the troughs for the first activity on the data curve are substantially near a first predetermined point; and identifying the first activity as picking up a tubular off of a first location and inserting it into a well based on a positive determination that substantially all of the peaks for the first activity on the data curve are substantially near a second predetermined point; wherein said steps are performed by a processor.

2. The method of claim 1 further comprising the step of recording the first activity in a computer storage medium.

3. The method of claim 1, wherein the block position data is from a service rig.

4. The method of claim 1, wherein the first location is a floor.

5. The method of claim 1, wherein the first predetermined point is at approximately five percent along a y-axis on the block position data chart.

6. The method of claim 1, wherein the second predetermined point is at approximately fifty percent along a y-axis on the block position data chart.

7. The method of claim 1, further comprising the steps of:

evaluating the display of block position data to determine if substantially all of the peaks for the first activity on the data curve are substantially near a third predetermined point based on a negative determination that substantially all of the peaks for the first activity on the data curve are substantially near a second predetermined point; and identifying the first activity as removing a tubular from the well and storing the tubular in a second location based on a positive determination that substantially all of the peaks for the first activity on the data curve are substantially near a third predetermined point.

8. The method of claim 7, wherein the third predetermined point is at approximately eighty-five percent along a y-axis on the block position data chart.

9. The method of claim 7, wherein the second location is a derrick on the rig.

10. The method of claim 1, further comprising the steps of:

evaluating the display of block position data to determine if a plurality of the peaks for the first activity on the data curve are above a fourth predetermined point; and disciplining a rig operator for allowing the position of the block position to exceed the fourth predetermined point.

11. The method of claim 10, wherein the fourth predetermined point is at approximately ninety percent along a y-axis on the block position data chart.

12. A method for determining an activity completed by a rig by analyzing a block position data chart comprising block position data, comprising the steps of:

establishing a limit on a range of block positions;

evaluating a display of block position data on a block position data chaff;

identifying a plurality of block position data on the block position data chart as a first activity;

observing if the first activity can complete successfully within the limit on a range of block positions;

resetting the limit on a range of block positions upon a negative determination of if the first activity can complete successfully within the limit on a range of block position, wherein the resetting the limit allows a positive determination of if the first activity can complete successfully within the limit on a range of block position; and identifying the first activity for the rig by evaluating the plurality of block position data wherein the block position data comprises a plurality of peaks and troughs along a curve representing a position of a block; wherein said steps are performed by a processor.

13. The method of claim 12 further comprising the step of recording the first activity in a computer storage medium.

14. The method of claim 12, wherein the block position data is from a well service rig.

15. The method of claim 12, wherein determining the first activity for the rig further comprises the steps of:

evaluating the display of block position data to determine if substantially all of the troughs for the first activity on the data curve are substantially near a first predetermined point;

evaluating the display of block position data to determine if substantially all of the peaks for the first activity on the data curve are substantially near a second predetermined point based on a positive determination that the substantially all of the troughs for the first activity on the data curve are substantially near a first predetermined point; and identifying the first activity as picking up a tubular off of a first location and inserting it into a well based on a positive determination that substantially all of the peaks for the first activity on the data curve are substantially near a second predetermined point.

16. The method of claim 15, wherein the first location is a floor.

17. The method of claim 15, further comprising the steps of:

evaluating the display of block position data to determine if substantially all of the peaks for the first activity on the data curve are substantially near a third predetermined point based on a negative determination that substantially all of the peaks for the first activity on the data curve are substantially near a second predetermined point; and identifying the first activity as removing a tubular from the well and storing the tubular in a second location based on a positive determination that substantially all of the peaks for the first activity on the data curve are substantially near a third predetermined point.

18. The method of claim 17, wherein the second location is a derrick on the rig.

19. The method of claim 15, further comprising the steps of:

evaluating the display of block position data to determine if a plurality of the peaks for the first activity on the data curve are above a fourth predetermined point; and disciplining a rig operator for allowing the position of the block position to exceed the fourth predetermined point.

* * * * *